United States Patent [19]

Canno

[11] Patent Number: 4,759,643

[45] Date of Patent: Jul. 26, 1988

[54] SELF-SEALING ENVELOPE

[75] Inventor: Leonard E. Canno, New York, N.Y.

[73] Assignee: Equitable Bag Company, Inc., Astoria, N.Y.

[21] Appl. No.: 88,671

[22] Filed: Aug. 24, 1987

[51] Int. Cl.[4] ..... B65D 33/16

[52] U.S. Cl. ..... 383/84; 206/628; 206/632

[58] Field of Search ..... 206/620, 604, 605, 608, 206/610, 611, 612, 622, 626, 628, 629, 631, 632, 634; 383/5, 84, 52

[56] References Cited

U.S. PATENT DOCUMENTS

| | | | |
|---|---|---|---|
| 3,310,225 | 3/1967 | Hoblit et al. | 206/632 |
| 4,276,982 | 7/1981 | Sibraua et al. | 383/84 |
| 4,464,158 | 8/1984 | Kardon | 383/5 |
| 4,468,811 | 8/1984 | Shaw et al. | 383/5 |
| 4,483,018 | 11/1984 | Whelan | 383/5 |
| 4,690,322 | 9/1987 | Burns | 206/632 |

*Primary Examiner*—Willis Little

*Attorney, Agent, or Firm*—Brumbaugh, Graves, Donohue & Raymond

[57] ABSTRACT

A self-sealing envelope in which the opening is defined between a taller flap and a shorter flap and the height of the shorter flap is such that when a protective peal-off tape is removed from a band of pressure sensitive material extending across the taller flap, the upper end of the shorter flap adheres to the lower region of the pressure sensitive band to seal the closure, leaving exposed the upper region of the adhesive band so that when the upper end of the envelope is folded down above the contents, the exposed adhesive band will adhere to the surface of the envelope across the width of the taller flap.

12 Claims, 4 Drawing Sheets

FIG. 6
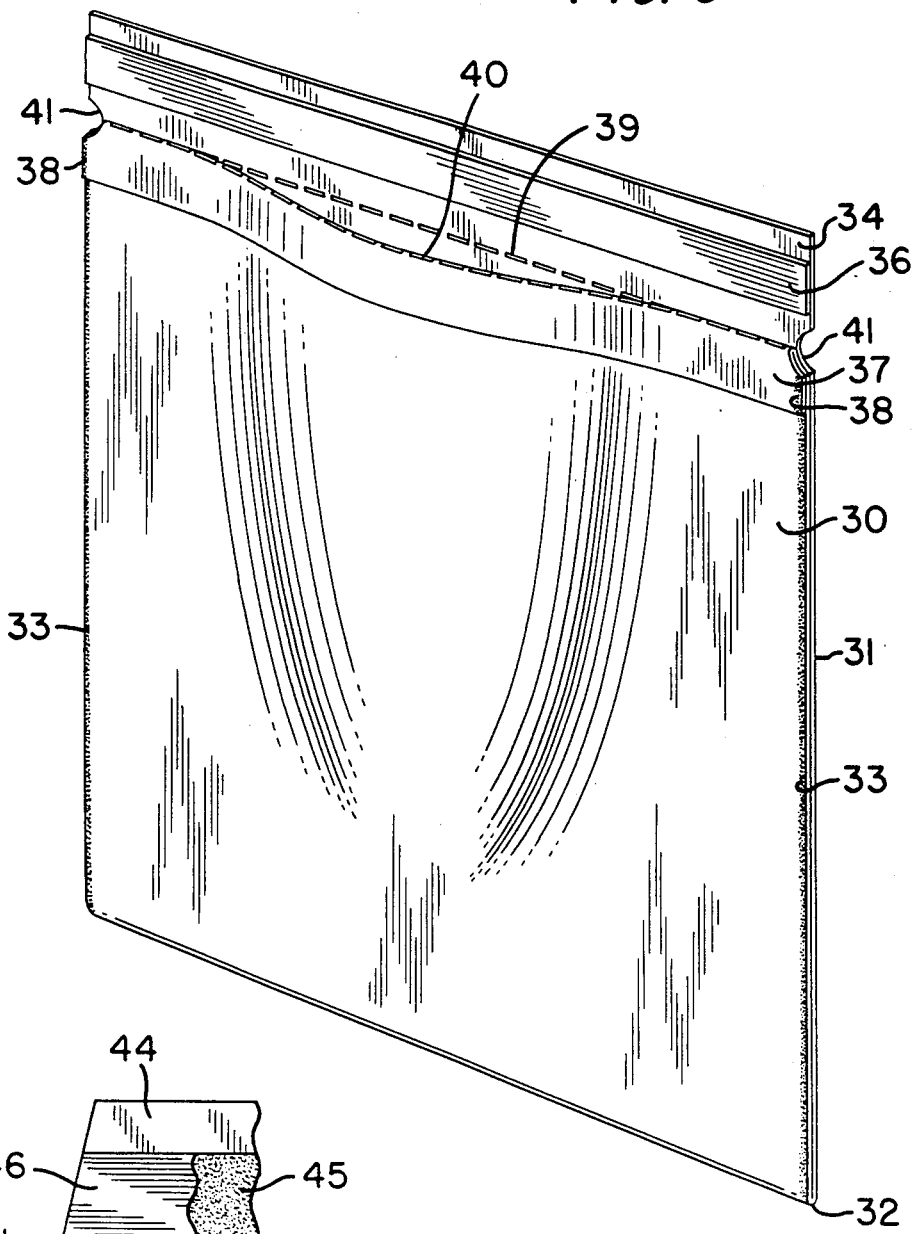
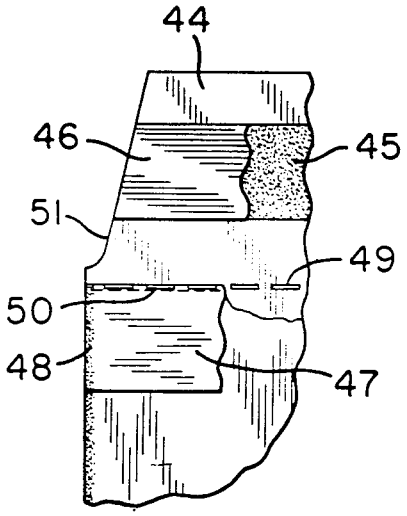
FIG. 9

SELF-SEALING ENVELOPE

BACKGROUND OF THE INVENTION

This invention relates to self-sealing envelopes, for example, of the type used for mailing merchandise and, in particular, to an improved closure for an envelope of this type.

Envelopes for mailing merchandise have been made of a sturdy, flexible plastic material having a single flap at the open end of the envelope. In one conventional self-sealing envelope of this type, the flap has a band of pressure sensitive adhesive material extending across the flap covered by a protective peel-off tape. When the merchandise is inserted in the envelope, the protective tape is removed and the upper end of the envelope is folded down above the upper end of the merchandise to bring the flap and the pressure sensitive band into engagement with the outer surface of the envelope, thereby compactly sealing the merchandise within the envelope.

In the improved closure of the present invention, the envelope opening is defined between a pair of flaps, one taller and the other shorter. A band of pressure sensitive adhesive material, covered by a protective peel-off tape, extends across the inner surface of the taller flap, and the height of the shorter flap is such that when the merchandise has been inserted in the envelope and the shorter flap is interfaced with the taller flap, the upper end of the shorter flap adheres to the lower region of the pressure sensitive band to seal the closure, leaving exposed the upper region of the adhesive band. When the upper end of the envelope is folded above the contents, the exposed region of the adhesive band can be adhered to the outer surface of the envelope across the width of the taller flap, thereby providing an effective closure for the envelope.

In a preferred embodiment of the present invention, side-by-side weakened tear lines are formed across the flaps below the pressure sensitive adhesive band to facilitate opening the envelope. In a preferred embodiment, small air vents are provided in the side edges of the envelope below the pressure sensitive adhesive band at both ends of the weakened lines to permit the escape of air from the envelope. Moreover, in a preferred embodiment, the shorter flap is initially detachably retained in a folded back position so that it will not be prematurely adhered to the adhesive band before the contents are inserted and the envelope is ready to be sealed.

For a more complete understanding of the present invention, reference can be made to the detailed description which follows and to the accompanying drawings.

THE DRAWINGS

FIG. 6 is a perspective view of an alternative embodiment of the envelope of the present invention shown in open condition;

FIG. 9 is a fragmentary view of still another embodiment of the envelope of the present invention.

THE PRIOR ART

Figure 2:
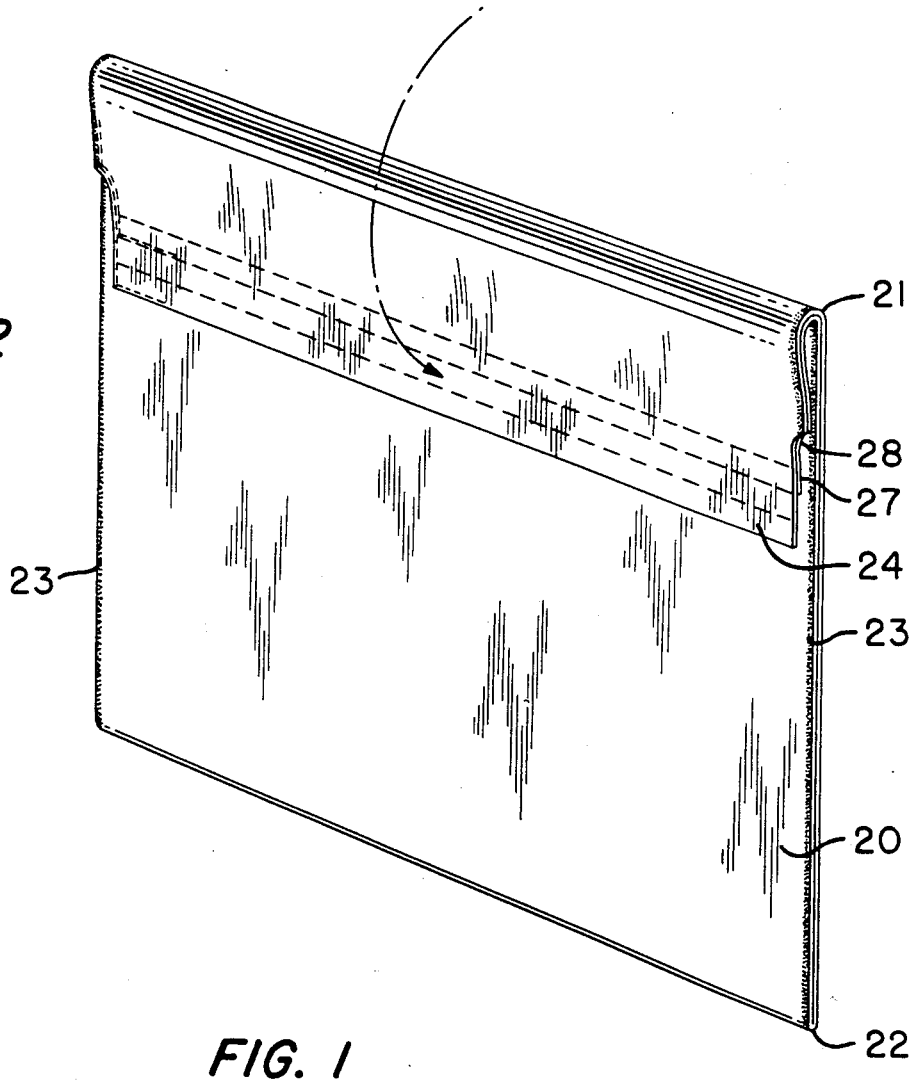
FIG. 2 is a perspective view of the heat-sealing envelope of the present invention showing the envelope closed
Figure 1:
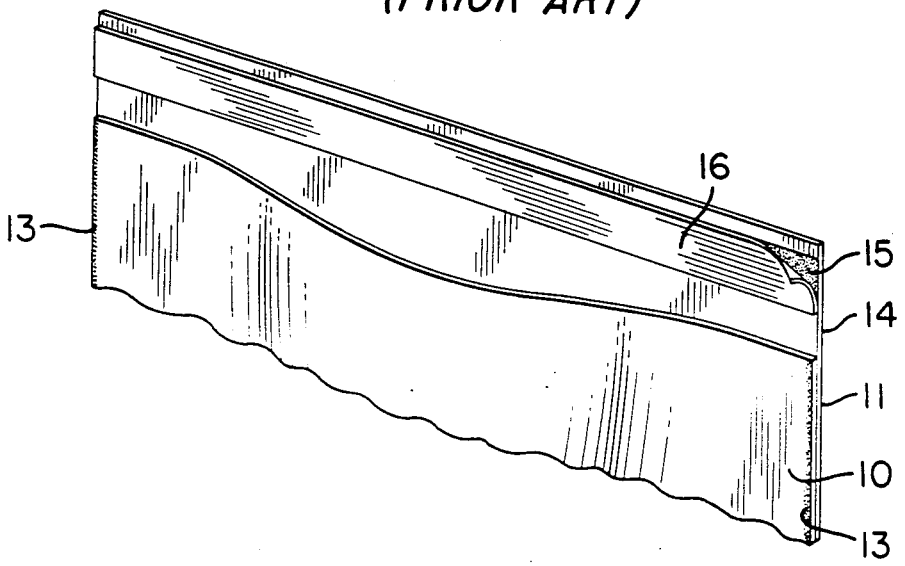
FIG. 1 (PRIOR ART)
FIG. 1 is a perspective view of the closure end of a prior art self-sealing envelope used for mailing merchandise.
Figure 3:
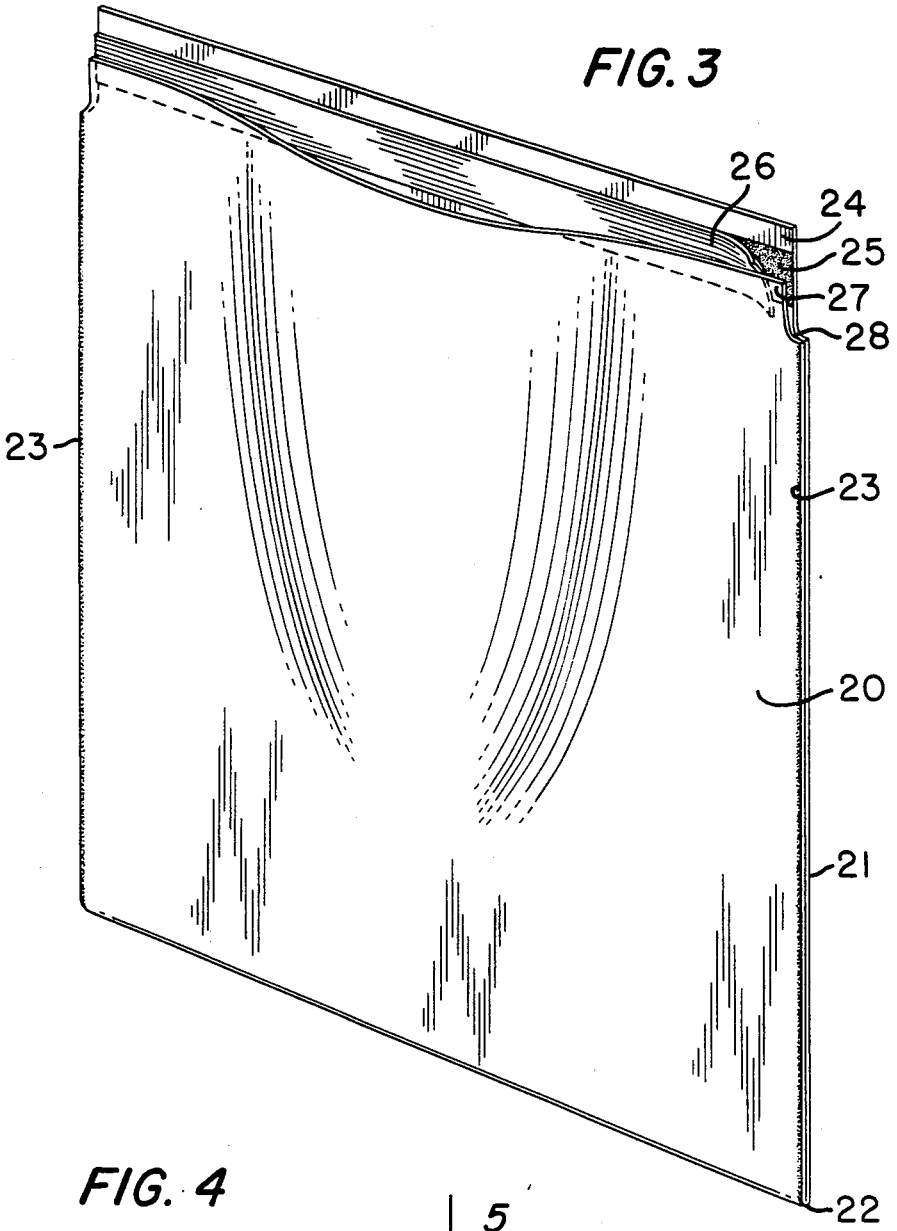
FIG. 3 is a perspective view of the envelope of the present invention showing the envelope open.
Figure 5:
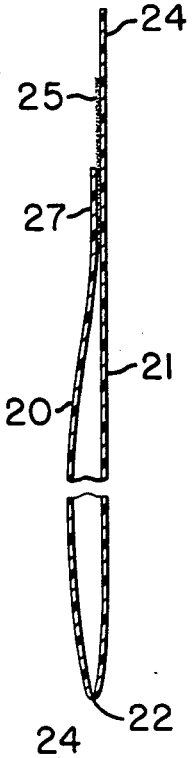
FIG. 5 is a section view of the envelope taken along the line 5—5 of FIG. 4.
Figure 4:
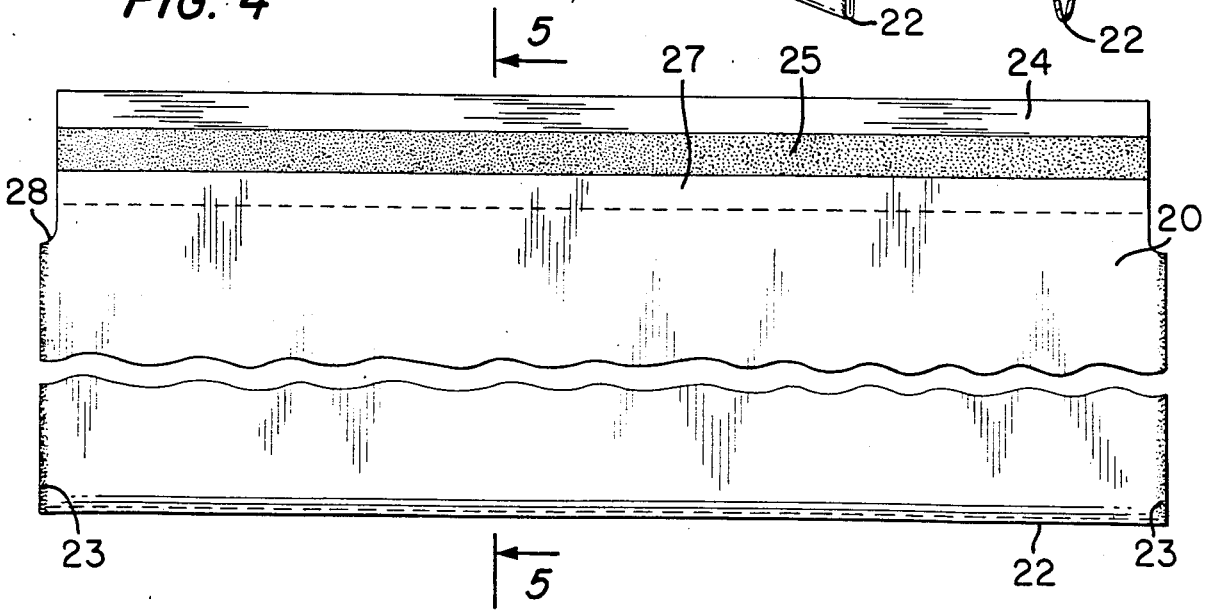
FIG. 4 is a front view of the envelope shown in FIG. 3.

In one conventional type of merchandise mailing envelope, shown in FIG. 1, the envelope includes a pair of panels 10 and 11 connected at the bottom by a fold and joined together along the side edges by heat seals 13. The upper end of the panel 11 extends above the upper edge of the panel 10 to provide a flap 14. A band 15 of pressure sensitive adhesive extends across the flap from one side edge to the other. A protective peel-off tape 16 covers the adhesive material. The envelope is made of a sturdy, flexible plastic material.

When the merchandise has been inserted in the envelope and the protective tape 16 is removed, the upper end of the envelope is folded downwardly above the upper end of the merchandise to enclose the contents compactly within the envelope. The pressure sensitive adhesive band 15 is pressed against the outer surface of the panel 10 to seal the envelope.

DETAILED DESCRIPTION OF THE INVENTION

Referring to FIGS. 2 to 5, the self-sealing envelope of the present invention includes a pair of panels 20 and 21 connected at the bottom by a fold 22 and joined together along the side edges by heat seals 23. The upper end of the panel 21 extends above the upper ends of the heat sealed edges to provide a taller flap 24. A band 25 of pressure sensitive adhesive extends across the flap 24 from one side edge to the other. A protective peel-off tape 26 covers the adhesive material.

The upper end of the panel 20 extends above the upper ends of the heat sealed edges to provide a shorter flap 27, the upper end of which interfaces with the lower region of the adhesive band when the protective tape is removed.

The envelope is made of a sturdy, flexible plastic material, for example, a combination high density and linear low density film or a coextruded structure or various resins of a guage within the range of about 1.5 to 5 mils. The envelope is capable of withstanding the normal handling to which it will be subjected in use.

The taller and shorter flaps 24 and 27, respectively, define between them an opening through which the merchandise is placed in the envelope. The envelope is then sealed by removing the protective tape 26 and interfacing the upper end of the flap 27 with the lower region of the adhesive band to provide a continuous seal across the interfacing flaps. The upper end of the envelope is then folded downwardly above the upper end of the merchandise to enclose the contents compactly within the envelope. The upper exposed band of the pressure sensitive adhesive is then pressed against the outer surface of the panel 20 to seal the envelope across the widths of the flap 24 and panel 20.

The flaps 24 and 27 are cut away at their ends 28 to provide small air vents below the adhesive band 25 so that the air can be exhausted from the envelope and the envelopes can be stacked or stored in the smallest possible space without entrapped air.

The self-sealing envelope of the present invention embodies a double seal, namely, an initial transverse seal across the entire width of the flaps 24 and 27 and an additional transverse seal across the entire width of the flap 24 and the outer surface of the panel 20.

Figure 7:
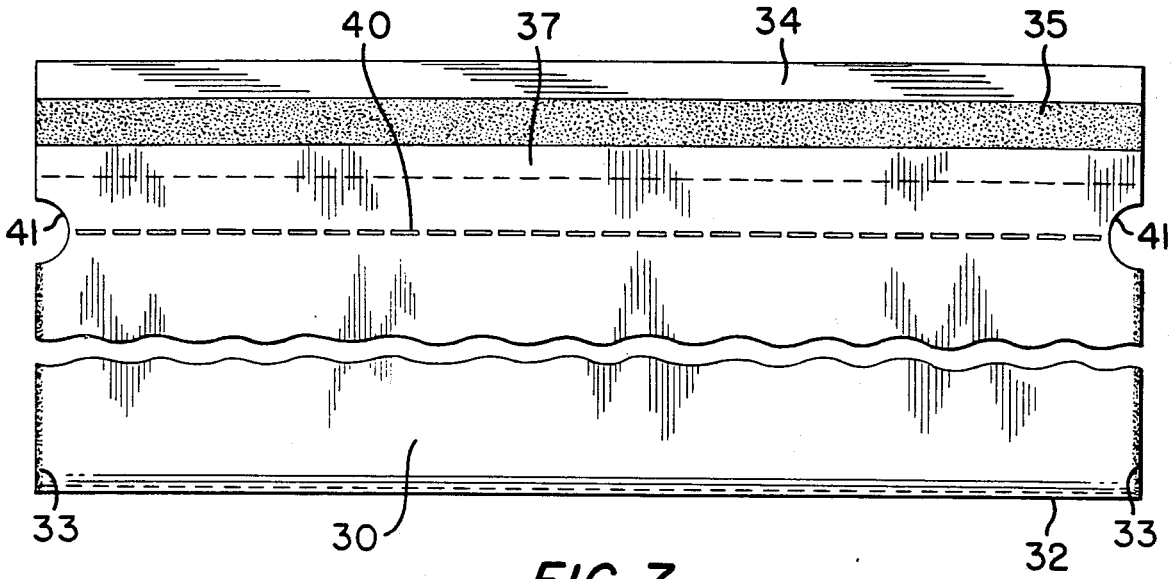
FIG. 7 is a front view of the envelope shown in FIG.6.
Figure 8:
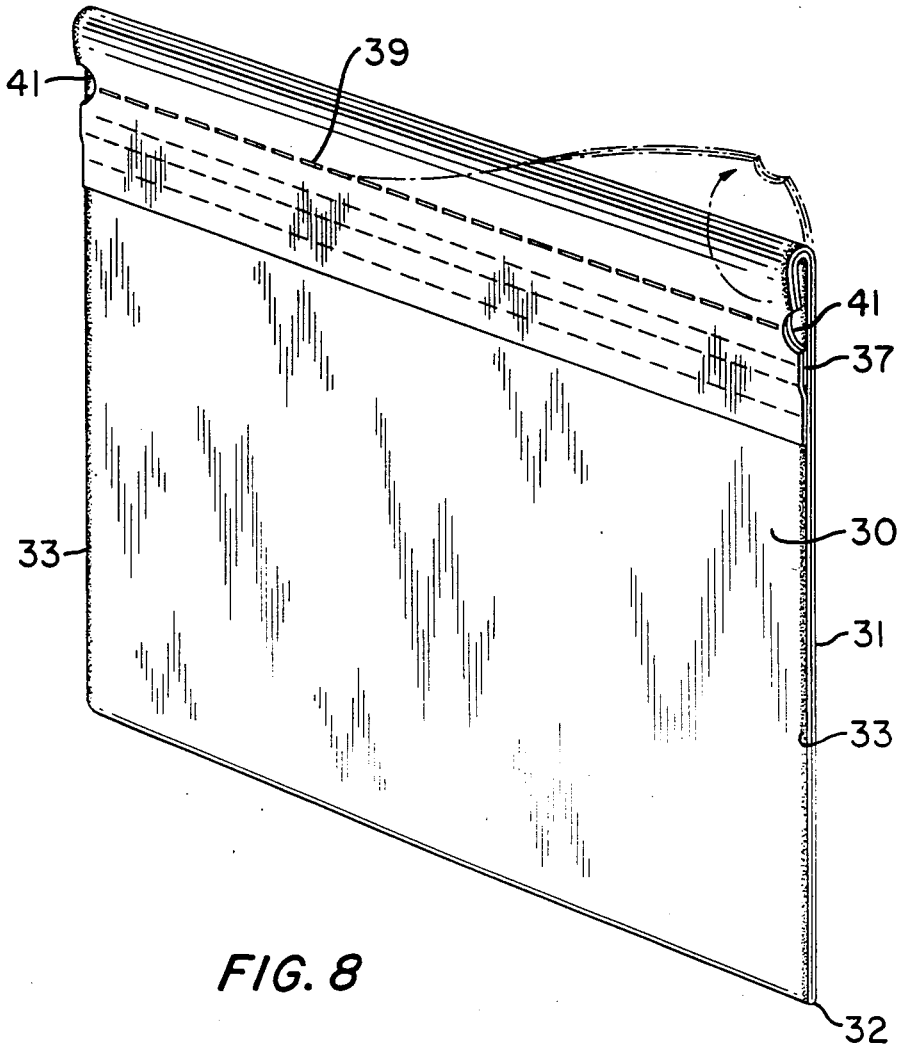
FIG. 8 is a perspective view of the envelope shown in FIGS. 6 and 7 in closed condition.

In a preferred alternative embodiment of the self-sealing envelope of the present invention, shown in FIGS. 6 to 8, the envelope includes a pair of panels 30 and 31 connected at the bottom by a fold line 32 and joined together along the side edges by heat seals 33. The upper end of the panel 31 extends above the heat seals 33 to provide a taller flap 34. A band 35 of pressure sensitive adhesive extends across the flap 34 from one side edge to the other, and a protective peel-off tape 36 covers the adhesive material.

The upper end of the panel 30 has a shorter flap 37 which is folded back against the outer surface of the panel 30 and heat sealed at 38 along opposite edges to anchor the flap 37 in folded back position until the merchandise has been inserted and the envelope is ready to be closed.

The flaps 34 and 37 are provided with side-by-side weakened tear lines 39 and 40, respectively, to facilitate opening the envelope. The weakened lines 39, 40 can be defined by a plurality of spaced-apart perforated lines ¼" in length separated by uncut spaces of ⅛" length.

When the merchandise is placed in the envelope, the protective tape 26 is removed to expose the adhesive band 35. The heat sealed ends 38 retain the shorter flap 37 in folded back position until the envelope is ready to be sealed, so that the shorter flap 37 will not be prematurely adhered to the adhesive before the flaps are ready to be sealed. The heat sealed ends of the lower flap are readily separated from the panel 30 to permit the flap 37 to be pivoted about its weakened line 40 to engage the lower region of the adhesive band 35. The upper end of the envelope is then folded downwardly above the upper end of the merchandise to bring the exposed upper region of the adhesive band into engagement with the outer surface of the panel 30.

The flaps 34 and 37 are both provided with notches 41 at opposite ends of the weakened tear lines 39, 40 to provide air vent passages which permit the air to be exhausted from the envelope when it is sealed. These notches 41 also provide ready access to the weakened lines 39, 40, as shown in FIG. 8, when the envelope is to be opened.

The envelope of the present invention can be made continuously from extruded plastic film by folding the panel 30 over the panel 31, forming the weakened lines 39, 40 in both panels simultaneously, folding back the panel 37 along the weakened line 40 and then simultaneously forming the heat seals 33 and 38. The adhesive band and the protective tape can then be applied to the inner surface of the flap 34 in the form of a precoated tape with a release liner or a pressure sensitive hot melt to which a protective tape with a release coating is applied.

In a modified alternative embodiment of the self-sealing envelope of the present invention, shown in FIG. 9, the closure of the envelope is defined between a taller flap 44 and a shorter flap 47. The taller flap 44 has a band 45 of pressure sensitive adhesive extending across it from one side edge to the other with a protective peel-off tape 46 covering the adhesive material. The shorter flap 47 is folded back and sealed at 48 to anchor it in folded back position until the merchandise has been inserted and the envelope is ready to be closed. The flaps 44 and 47 are provided with side by side weakened tear lines 49 and 50 to facilitate opening the envelope. The flap 44 is provided with a tapered cut away portion 51, which extends from above the tear line 49 to the upper end of the flap 44 so that the unsealed portion adjacent the tapered line below the pressure sensitive adhesive band 45 provides an air vent to the envelope when the envelope is sealed.

The invention has been shown in preferred forms and by way of example only, and many modifications and variations can be made therein within the spirit of the invention. For example, the panels of the envelope can be connected along the side edges and bottom by gussets to accommodate bulkier merchandise. The invention, therefore, is not intended to be limited to any specified form or embodiment except insofar as such limitations are expressly set forth in the claims.

I claim:

1. A self-sealing closure for an envelope comprising a pair of flaps defining between them an opening for placing the contents within the envelope, one of the flaps being taller and the other being shorter, a band of pressure sensitive adhesive material extending across the taller flap and a protective peel-off tape covering the adhesive material, the height of the shorter flap being such that when the protective tape is removed and the shorter flap is interfaced with the taller flap, the upper end of the shorter flap adheres to the lower region of the pressure sensitive adhesive band to seal the closure, leaving exposed the upper region of the adhesive band so that, when the upper end of the envelope is folded down above the contents, the exposed adhesive band will adhere to the surface of the envelope across the width of the taller flap.

2. A self-sealing closure as set forth in claim 1 including a cut-away portion in at least one of the flaps to provide an unsealed air vent between the flaps to allow air to escape from the envelope when it is sealed.

3. A self-sealing closure as set forth in claim 1 including detachable means for holding the shorter flap in folded-back position to prevent it from prematurely adhering to the adhesive material.

4. A self-sealing closure for an envelope as set forth in claim 3 in which the envelope includes a pair of panels heat sealed together along the side edges and the folded-back flap is detachably retained at opposite side edges by detachable seals.

5. A self-sealing closure as set forth in claim 1 including weakened tear lines formed across both flaps below the adhesive band to facilitate opening the envelope.

6. A self-sealing closure as set forth in claim 5 including air vent notches in a flap at both ends of the weakened tear line.

7. A self-sealing closure as set forth in claim 5 in which the weakened tear lines of the flap are side-by-side so that they are separated simultaneously to open the envelope.

8. A self-sealing envelope comprising a pair of panels joined together along the bottom and sides to define an envelope which is open at the top, a taller flap at the upper end of one of the panels, a band of pressure-sensitive adhesive material extending across the flap from one side to the other, a protective peel-off tape covering the adhesive material, and a shorter flap at the upper end of the other panel, the height of the shorter flap being such that when the protective tape is removed and the upper end of the shorter flap is interfaced with the taller flap, the upper end of the shorter flap adheres to the lower region of the pressure sensitive adhesive band, leaving exposed the upper region of the adhesive band so that the upper end of the envelope can be folded down above the contents thereof to adhere the exposed strip of adhesive to the panel having the shorter flap, the exposed adhesive strip adhering the flap to the adjacent panel across the width of the envelope, thereby providing an effectively sealed envelope.

9. A self-sealing envelope as set forth in claim 8 including detachable means retaining the shorter flap in folded-back position to prevent it from prematurely adhering to the adhesive material.

10. A self-sealing envelope as set forth in claim 8 including weakened tear lines along both flaps below the band of adhesive material to facilitate opening the envelope.

11. A self-sealing envelope as set forth in claim 10 including air vents between the flaps intermediate the adhesive band and the weakened tear lines.

12. A self-sealing envelope as set forth in claim 9 including heat seal means for joining together both the side edges of the panels and the ends of the folded-back flap to the adjacent panel, the seals retaining the folded-back flap being readily detachable to pivot the folded-back flap into interfacing relation with the other flap.

* * * * *